US009157203B2

(12) United States Patent
Heselden

(10) Patent No.: US 9,157,203 B2
(45) Date of Patent: Oct. 13, 2015

(54) BARRIER ASSEMBLY

(75) Inventors: James Heselden, Wetherby (GB); Thomas L. Brand, legal representative, Yorkshire (GB)

(73) Assignee: HESCO BASTION LIMITED, Leeds (GB)

( * ) Notice: Subject to any disclaimer, the term of this patent is extended or adjusted under 35 U.S.C. 154(b) by 199 days.

(21) Appl. No.: 13/153,965

(22) Filed: Jun. 6, 2011

(65) Prior Publication Data

US 2011/0305511 A1 Dec. 15, 2011

(30) Foreign Application Priority Data

Jun. 11, 2010 (GB) ..... 1009802.8

(51) Int. Cl.

| | |
|---|---|
| ***E02B 3/04*** | (2006.01) |
| ***E02B 3/06*** | (2006.01) |
| ***E02B 3/12*** | (2006.01) |
| ***E02D 29/02*** | (2006.01) |

(52) U.S. Cl.

CPC ... *E02B 3/04* (2013.01); *E02B 3/06* (2013.01); *E02B 3/124* (2013.01); *E02D 29/0208* (2013.01)

(58) Field of Classification Search

CPC ..... E02D 29/0208; E02D 17/202; E02B 3/04; E02B 3/06; E02B 3/124

USPC ..... 405/15, 16, 19, 21, 30, 32, 33, 284, 405/287, 287.1, 302.6, 302.7

See application file for complete search history.

(56) References Cited

U.S. PATENT DOCUMENTS

| | | | | |
|---|---|---|---|---|
| 4,530,622 | A | 7/1985 | Mercer | |
| 4,666,129 | A * | 5/1987 | Dobson | 256/2 |
| 6,659,686 | B2 * | 12/2003 | Veazey | 405/16 |

(Continued)

FOREIGN PATENT DOCUMENTS

| | | |
|---|---|---|
| EP | 2 136 001 | 12/2009 |
| GB | 2 432 611 | 5/2007 |
| JP | 11336047 | 12/1999 |

(Continued)

OTHER PUBLICATIONS

Combined Search and Examination Report under Sections 17 and 18(3) of international application No. GB1009802.8, dated Sep. 21, 2010.

*Primary Examiner* — Benjamin Fiorello

*Assistant Examiner* — Carib Oquendo

(74) *Attorney, Agent, or Firm* — Ping Wang; Andrews Kurth LLP

(57) ABSTRACT

There is disclosed a barrier assembly for shoreline preservation or restoration comprising a gabion having opposed side walls connected together at spaced intervals along the length of the gabion by a plurality of partition walls, the spaces between neighboring pairs of partition walls defining, together with the side walls, at least one individual compartment of the gabion, the at least one individual compartment of the gabion being bounded by the respective opposed side walls or by opposed side wall sections of the respective opposed side walls, the partition walls being pivotally connected to the side walls, the individual compartment of the gabion having extending therefrom in a direction away from the individual compartment convergent at least partly open framework panels forming or forming part of a protuberant compartment on the gabion. A method of preserving and restoring a shoreline, and use of a barrier assembly is also disclosed.

53 Claims, 6 Drawing Sheets

(56) References Cited

U.S. PATENT DOCUMENTS

| | | | | |
|---|---|---|---|---|
| 2008/0247830 | A1* | 10/2008 | Heselden | 405/273 |
| 2010/0024343 | A1* | 2/2010 | Eggermont | 52/648.1 |

FOREIGN PATENT DOCUMENTS

| | | | | |
|---|---|---|---|---|
| JP | 2002138439 | * | 5/2002 | E02B 3/08 |
| JP | 2006-104666 | | 4/2006 | |

* cited by examiner

BARRIER ASSEMBLY

This application claims the priority of Great Britain Patent Application No. GB 1009802.8 filed on Jun. 11, 2010, the entirety of which is incorporated herein by reference.

FIELD

The present invention relates to a barrier assembly, and more particularly to a barrier assembly for shoreline preservation and restoration. The present invention also relates to a method of preserving and restoring a shoreline, and use of a barrier assembly.

BACKGROUND

Hurricanes are one of many natural disasters that seriously affect people all over the world. In particular, hurricanes pose a serious threat to coastlines and their surrounding eco-systems. The loss of shorelines and coastal areas due to storm activity can be a devastating event. Almost every year, several areas suffer from significant casualties and damage caused by hurricane winds, rain and storm surge.

Hurricanes and other natural disasters have the ability to destroy farmland and vegetation, which is a vital resource to humans. It becomes necessary to protect existing cultivated areas and to replace those that have been destroyed. This can, however, be a difficult task. The present invention addresses this problem.

Another significant problem caused by hurricanes and other natural disasters is the disruption and/or destruction of the underwater eco-system surrounding shorelines. The natural habitat of marine life and the marine life itself can be decimated and measures are, therefore, needed to restore the habitat to attract marine life back into areas surrounding devastated shorelines. The present invention also addresses this problem.

Marshlands adjacent susceptible coastal regions provide at least some form of protection against the harsh environments caused by hurricanes. Typically, marshlands offer a first line of defense for populated areas against the wave energy of a hurricane. The marshlands act as a barrier to absorb, redirect or dissipate the wave energy so that by the time it reaches a populated area its force is significantly reduced thereby limiting the damaged inflicted on the populated area.

However, on occasion the force of the wave energy is such that marshlands are themselves swept away or destroyed leaving little, or no, protection to the populated areas. Clearly, this is a cause for concern.

Although measures have been taken to resurrect destroyed marshlands in areas such as coastal Louisiana following hurricane Katrina, these have been found to have major drawbacks. This is because in order for marshlands to be effective at dissipating wave energy, large stretches are needed to reduce a large storm surge to a more or less harmless level. However, in order to create large stretches, vast amounts of sediment are necessary which makes this process less feasible in terms of cost and logistics.

Coastal erosion caused by wave energy or other natural forces is a particularly daunting problem for a seaside city. The subsidence of the coastline can be catastrophic in such places and, therefore, it is important that these places are adequately protected.

Coastlines have thus been lined with gabion structures to inhibit subsidence thereof, but the gabion structures are generally square and form a flat surface which faces the oncoming wave energy. The flat surface tends to finds it difficult to redirect and dissipate the wave energy, and instead experiences the full impact of the wave. Indeed, if the wave energy is of sufficient strength, for instance, or if it collides with the gabion faces often enough, it is possible that the gabion structure will become damaged and will require very regular maintenance and repair. This can be labor intensive and costly.

From the discussion that is to follow, it will become apparent how the present invention addresses the aforementioned deficiencies while providing numerous additional advantages not hitherto contemplated or possible with known constructions.

SUMMARY

According to a first aspect, the present invention provides a barrier assembly for shoreline preservation or restoration comprising a gabion having opposed side walls connected together at spaced intervals along the length of the gabion by a plurality of partition walls, the spaces between neighboring pairs of partition walls defining, together with the side walls, at least one individual compartment of the gabion, the at least one individual compartment of the gabion being bounded by the respective opposed side walls or by opposed side wall sections of the respective opposed side walls, the partition walls being pivotally connected to the side walls, the individual compartment of the gabion having extending therefrom in a direction away from the individual compartment convergent at least partly open framework panels forming or forming part of a protuberant compartment on the gabion The barrier assembly provides means for rebuilding the underwater eco-system and also allows vegetation to grow therefrom. In essence, the present invention provides a combination of effects.

On one hand, the protuberant compartment can be filled with marine dwelling medium, such as oyster shells, so as to attract oysters and other marine life into the surrounding area. Marine life, including oysters, can attach itself to the oyster shells protruding through the open framework of the protuberant compartment whereby to grow outwardly into the sea. This enables the barrier assembly to naturally repair itself without requiring maintenance of the protuberant compartment or refilling of the protuberant compartment because the marine life which attaches itself to the barrier assembly essentially becomes part of the barrier assembly. Attached marine life can in turn attract further marine life and the cycle may thus continue. This provides a way in which to build or re-establish a self-generating thriving underwater eco-system. There may be created a "barrier reef".

On the other hand, the at least one individual compartment can be filled with vegetation and/roots to grow outwardly therefrom into the surrounding land area. This provides a mechanism for cultivation of areas surrounding damaged shorelines.

These effects allow the restoration and preservation of shorelines, for example.

The barrier assembly may also protect adjacent areas of the coastal region by reducing the effects of the wave energy of, for instance, a hurricane. The barrier assembly may redirect, absorb or redistribute the forces of the wave energy, thereby protecting neighboring areas, such as populated areas.

The barrier assembly can be used, for example, to line a coastline to inhibit its subsidence by a greater extent than known measures. The external surface of the protuberant compartment allows the barrier assembly to redirect wave energy efficiently and effectively. The angle of configuration of the panels forming the protuberant compartment may be such that the force of the wave energy is dissipated in a "glancing" manner so that the barrier assembly need not experience the entire impacting force of the wave energy. This may preserve the integrity of the barrier assembly to a greater degree than known barriers so that frequent labor-intensive maintenance need not be required.

Another benefit of the barrier assembly is the filtering capacity offered by the combination of oyster shells and the protuberant compartment (including chambers of non-protuberant compartments). This may act to remove debris from the water to make the area more pleasant for sea-users such as swimmers, for example. It may also help reduce pollution which could otherwise adversely affect marine life. There may, therefore, be provided a natural filtering mechanism.

It will be appreciated that the protuberant compartment may take a variety of shapes including semi-circular, quadrilateral, pyramidal and pentagonal.

The barrier assembly may comprise a multi-compartmental gabion having opposed side walls connected together at spaced intervals along the length of the gabion by a plurality of partition walls, the spaces between neighboring pairs of partition walls defining, together with the side walls, individual compartments of the multi-compartmental gabion, individual compartments of the multi-compartmental gabion being bounded by opposed side wall sections of the respective opposed side walls, the partition walls being pivotally connected to the side walls and neighboring side wall sections being pivotally connected to each other, a first individual compartment of the gabion having extending therefrom in a direction away from the first individual compartment convergent at least partly open framework panels forming or forming part of a protuberant compartment on the gabion.

It may be that a second individual compartment of the gabion neighboring the first individual compartment is absent any protuberant compartment of the same shape or size as the protuberant compartment extending from the first individual compartment. More particularly, the second individual compartment may be absent any protuberant compartment. The second individual compartment may provide additional means for receiving vegetation and/roots to grow outwardly therefrom into the surrounding land area. This provides an improved mechanism for cultivation of areas surrounding damaged shorelines. The second individual compartment may also provide additional means by which wave energy may be redirected. It may be that the wave energy flows along the surface of the second individual compartment having initially contacted the first individual compartment.

In embodiments, a second individual compartment neighboring the first individual compartment may comprise at least two chambers. One of the chambers may provide additional means for receiving vegetation and/roots to grow outwardly therefrom into the surrounding land area. Another chamber may receive marine dwelling medium, such as oyster shells, so as to attract oysters and other marine life into the surrounding area. Marine life, including oysters, can attach itself to the oyster shells protruding through the chamber whereby to grow outwardly into the sea. This enables the barrier assembly to naturally repair itself without requiring maintenance of the chamber or refilling of the chamber because the marine life which attaches itself to the barrier assembly essentially becomes part of the barrier assembly. Attached marine life can in turn attract further marine life and the cycle may thus continue. This provides a way in which to build or re-establish a self-generating thriving underwater eco-system. There may be created a "barrier reef".

The chambers may be unequal in size. They may be disproportional in size. For example, one chamber may be a quarter the width of another chamber. The proportion of the sizes may be dependent on the intended use of the barrier assembly; that is, if the emphasis is to restore marine life then the chamber facing the sea may be larger; conversely, if the emphasis is to cultivate the surrounding shoreline area then the chamber facing in-land may be larger.

The chambered compartment may have a parallelepiped structure. Each chamber may have a rectangular-cross section. Together, the chambers of a second compartment may amount to the same dimensions as those of the first individual compartment. This may improve space optimization when multiple assemblies are stacked on top of one another.

The barrier assembly may comprise a plurality of protuberant compartments along the length of the gabion, neighboring protuberant compartments being separated from each other by a length of side wall.

The length of side wall may correspond in length to the length of a side wall section. More particularly, the length of side wall is a side wall section.

It may be that at least parts of the neighboring protuberant compartments and the length of side wall define a channel. The channel may be substantially continuous. The channel may provide a particularly effective way in which to dissipate the wave energy. The wave energy can be concentrated into the channel and dispersed therefrom. The wave energy may be dissipated upwardly or downwardly from the channel, for example. This is in contrast with a flat surface which makes a full impact with the wave causing damage to itself.

The barrier assembly may comprise an even numbers of compartments, preferably four compartments. This may constitute a barrier assembly having a manageable number of compartments in terms of transport and construction.

The convergent panels may form triangular compartments.

The at least one individual compartment may have a square-cross section. This may aid optimization of space when the multiple compartments are adjacently located.

The at least one individual compartment may be lined with a geotextile material. A geotextile can be lightweight, strong and porous; which characteristics lend themselves to the objective of the present invention. The geotextile material may include polyolefins such as polypropylene, polyethylene and copolymers thereof; rayon; polyesters; nylon; acrylic polymers and copolymers; polyamides; polyamide copolymers; polyurethanes, and the like.

The porous material may line an inwardly facing surface of the at least one individual compartment. The porous material may line an outwardly facing surface of the at least one individual compartment. The porous material may line both an inwardly and outwardly facing surface of the at least one individual compartment. The efficiency of the assembly may be enhanced by lining both/all surfaces of the at least one individual compartment.

The at least one individual compartment may be at least partly filled with a fill material, such as sand, rocks and/or vegetation. The fill material may stabilize the assembly and weigh it down. The fill material may be porous in nature, such as an aggregate material so that wave energy may be dissipated rather than repelled. Where the fill material is vegetation, the assembly may offer a dual function of protection and cultivation.

It may be that at least the protuberant compartment has a mesh form. A mesh form is advantageous because it utilizes less material than a solid panel of the same dimensions, while potentially providing the same level of strength of a solid panel. Material costs may, therefore, be reduced. A mesh is also porous in nature; which characteristic lends itself to an objective of the present invention. Of course, the at least one individual compartment may also have a mesh form.

The at least one individual compartment may be in box form. The box form may not have a plurality of panels; rather being formed as a single unit, which is structurally uncomplicated compared with a compartment formed from a plurality of panels, for example. This may improve its sturdiness.

The protuberant compartment may be at least partly filled with oyster shells or the like. Of course, the triangular compartment may be entirely filled with oyster shells or the like. This may enhance the performance of the assembly.

Oyster shells may be arranged to protrude through the at least partly open framework of the protuberant compartment and sit proudly of its surface. Such an arrangement may improve the ability of the assembly to attract other marine life. More particularly, it may attract oysters which may eventually grow outwardly into the sea thereby enhancing the strength and efficacy of the barrier assembly.

The protuberant compartment may be detachably attached to the at least one individual compartment. This may be of assistance when the assembly is to be transported between locations. Storage may also be simplified. Of course, the protuberant compartment may be integrally formed with the at least one individual compartment.

The barrier assembly may comprise a strengthening member for the protuberant compartment. The strengthening member may be in the form of a panel. The strengthening member may be in the form of a mesh panel. The strengthening member may improve the structural integrity of the protuberant compartment, particularly at its apex when in triangular form, and ultimately improve the structural integrity of the assembly.

The protuberant compartment may be a triangular compartment and the strengthening member may be positioned along its median.

The strengthening member may be positioned along the median connecting the midpoint of an interior wall of the triangular compartment and the protruding apex of the triangular compartment. It may be considered important to ensure that the apex is reinforced since it is this point at which the wave energy may be primarily diverted onto a different course.

The protuberant compartment may be pivotally connected to the at least one individual compartment. This may be particularly advantageous if the compartments are required to be collapsible.

The protuberant compartment may comprise two panels forming a triangular configuration with the at least one individual compartment. Each compartment may be formed from a plurality of framework panels. Repair and maintenance of a compartment may, therefore, be made with ease in case any particular panel is in need of replacement. This avoids the need to replace the compartment in its entirety thereby reducing costs to maintain the system. This may also preclude hindering the restoration/preservation process during maintenance work, since only a single panel may need replacing as opposed to an entire compartment.

It may be that each edge of the at least two panels is connected to the respective edge of the at least one individual compartment by at least two overlapping helical coils. Such an arrangement may lend itself to detachably attaching the protuberant compartment, particularly a triangular compartment, to the at least one individual compartment in a pivotal manner.

The at least two overlapping helical coils may be releasably connected by a joining pin intersecting the overlapping region of the coils, thereby detachably securing the coils and panels together.

It may be that the edges of the panels which define a protruding apex of the triangular compartment are connected to one another by a single helical coil. A helical coil may, for example, be intertwined between adjacent panels of a gabion thereby connecting them. A helical coil may be in one panel and thus its structural integrity will be sound as compared with hinge members employing an assimilation of parts. The helical coil may also be unwound, when necessary, so as to disconnect adjacent panels or walls of the assembly without undue burden.

The apex of the protruding triangular compartment may comprise an interior angle which is obtuse. The apex of the protruding triangular compartment may comprise an interior angle which is acute. The strength of the apex may be determined by the interior angle of the apex; thus, the interior angle of the apex may be dependent on the force of the wave energy that must be counteracted.

A chamber may comprise three panels forming a rectangular arrangement with another chamber. In this way, the other chamber may provide effectively the fourth panel/side of the first chamber. Alternatively, a partition wall in the second individual compartment may divide it into at least two chambers. This arrangement may make the assembly lighter and less costly due to reduced material use.

It may be that the edges of the panels are connected to the at least one individual compartment by a respective helical spring. A pivotal motion may be provided in this manner. The helical spring also lends itself to the collapsible nature of the assembly, when this is required.

The barrier assembly may comprise an even number compartments; more particularly, an even number of first individual compartments and an even number of second individual compartments. An even number of each type of compartment helps ensure that when multiple assemblies are placed next to one another when lining a coastline, for example, first and second compartments can be positioned alternately when in a linear relationship.

The first and second compartments may have a linear relationship, and each compartment may be alternately positioned. Replicating patterns can thus be realized when multiple assemblies are placed next to one another. This may aid the efficacy of the design of the barrier assembly.

The barrier assembly may be collapsible. This improves the usage of space during transport because the assembly may be "flat packed". Carrying an assembly is also made easier in a stowed-collapsed form. Quick and easy erection is also desirable in hostile environments.

According to a second aspect, the present invention comprehends a method of preserving or restoring a shoreline, comprising the steps of: providing a barrier assembly comprising a gabion having opposed side walls connected together at spaced intervals along the length of the gabion by a plurality of partition walls, the spaces between neighboring pairs of partition walls defining, together with the side walls, at least one individual compartment of the gabion, the at least one individual compartment of the gabion being bounded by the respective opposed side walls or by opposed side wall sections of the respective opposed side walls, the partition walls being pivotally connected to the side walls, the individual compartment of the gabion having extending therefrom in a direction away from the individual compartment convergent at least partly open framework panels forming or forming part of a protuberant compartment on the gabion; at least partly filling the at least one individual compartment with a fill material, preferably sand, rocks and/or vegetation;

at least partly filling the protuberant compartment with oyster shells; and at least partly lining a shoreline with the barrier assembly.

The method may include the step of lining the at least one individual compartment with a geotextile material before it receives any fill material.

The method may include the step of providing at least two individual compartments and positioning them in a linear relationship.

According to a third aspect of the present invention, there is envisaged the use of a barrier (as described herein) in redirecting wave energy, particularly sea wave energy.

According to a fourth aspect of the present invention, there is contemplated the use of a barrier (as described herein) in preserving a shoreline.

According to a fifth aspect, the present invention provides the use of a barrier (as described herein) in restoring a shoreline.

BRIEF DESCRIPTION OF THE DRAWINGS

Various embodiments of the present invention will now be more particularly described, by way of example only, with reference to the accompanying drawings, in which.

DETAILED DESCRIPTION

Figure 1:
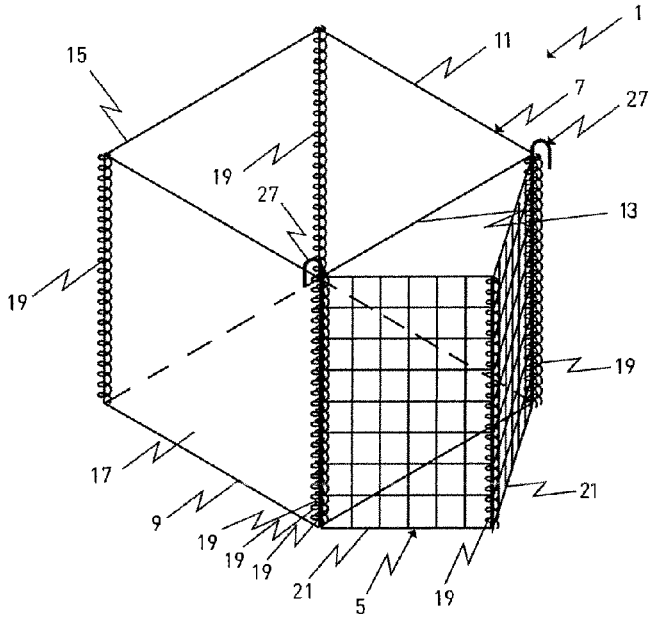
FIG. 1 is a perspective view of a barrier assembly having a first individual compartment formed according to an embodiment of the present invention.

Referring first to FIG. 1, there is illustrated a barrier assembly generally indicated 1. In this embodiment, the barrier assembly is constituted by a first individual compartment 7. The first individual compartment 7 having extending therefrom in a direction away from the individual compartment 7 a protuberant compartment in the form of a triangular compartment 5 connected to the first individual compartment 7. Of course, it will be appreciated that the protuberant compartment may have a different shape in other embodiments.

The first individual compartment 7 is an open-top cuboid formed from five square panels. There are two opposing side walls 13, 15, two partition walls 9, 11 and a base 17. These walls are connected at their respective edges by a helical coil 19. The walls are solid, but it will be appreciated that in other embodiments the walls may have a mesh form. Of course, it will be understood that the base 17 is not essential as the ground upon which the assembly 1 rests may provide the same function.

The triangular compartment 5 comprises two angled panels 21 which are connected to the first individual compartment 7 such that the side wall 13 makes up the third side of the triangular compartment 5. The two angled panels 21 have a mesh form and define an external surface of the first individual compartment 7.

Figure 2:
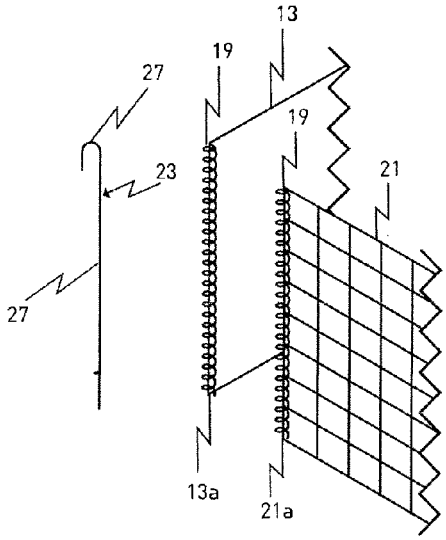
FIG. 2 is an exploded view of part of the triangular compartment (protuberant compartment) of FIG. 1.

With reference to FIG. 2, there is illustrated an exploded view of an angled panel 21 and side wall 13. Respective edges 13*a* and 21*a* of the side wall 13 and angled panel 21 are each lined with a helical coil 19. In this way, the side wall 13 and panel 21 can be pivotally connected. There is also shown a joining pin 23 which is rod-shaped member 25 having a hooked end 27.

Figure 3:
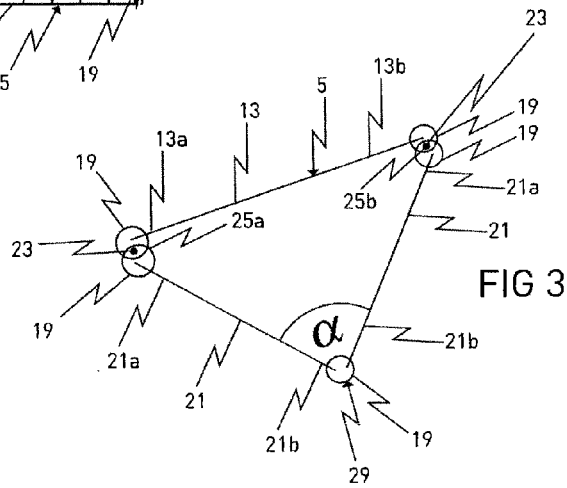
FIG. 3 is a plan view of the triangular compartment of FIG. 1.

FIG. 3 shows a plan view of the triangular compartment 5. The side wall 13 is provided with a helical coil 19 at either of its opposite edges 13*a*, 13*b*. Each angled panel 21 is provided with a helical coil 19 at its edge 21*a*. The helical coils 19 of edges 21*a* are intertwined with the helical coils 19 of edges 13*a*, 13*b* to define two overlapping regions 25*a*, 25*b*. A joining pin 23 intersects each overlapping region 25*a*, 25*b* to connect the side wall 13 to the two angled panels 21. The two angled panels 21 are connected to one another by a single helical coil 19 which joins respective edges 21*b*, thereby defining a protruding apex 29. The interior angle $\alpha$ at the apex 29 is 91 so it is obtuse. Of course, in other embodiments, the interior angle $\alpha$ may be acute.

Figure 4:
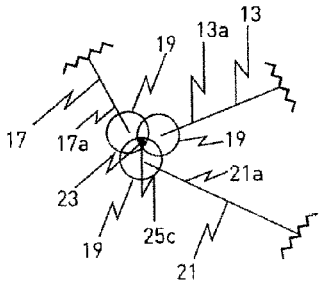
FIG. 4 is a plan view of part of the triangular compartment and part of the first individual compartment of FIG. 1.

Referring now to FIG. 4, there is shown a more detailed plan view of the connection region of the side wall 13, partition wall 17 and angled panel 21. Each respective edge 13*a*, 17*a*, 21*a* is provided with a helical coil 19. The three helical coils 19 overlap to effect an overlapping region 25*c*. The overlapping region 25 is intersected by joining pin 23 to connect the walls 13, 17 and panel 21 together.

Figure 5:
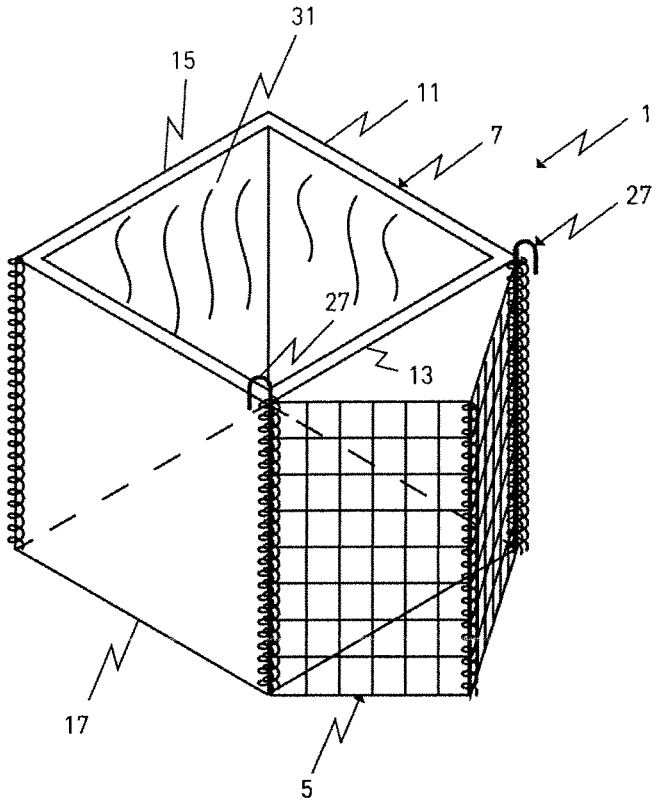
FIG. 5 is a perspective view of the barrier assembly of FIG. 1 in which the first individual compartment is lined with a geotextile material.

With reference to FIG. 5, there is illustrated the barrier assembly 1 of FIG. 1 in which the first individual compartment 7 is lined with a geotextile material 31. More particularly, it is the inwardly facing surface of each wall 9, 11, 13, 15 and base 17 that is lined with the geotextile material 31. The geotextile material 31 acts to hold fill material in place and also provides a filtering mechanism.

Figure 6:
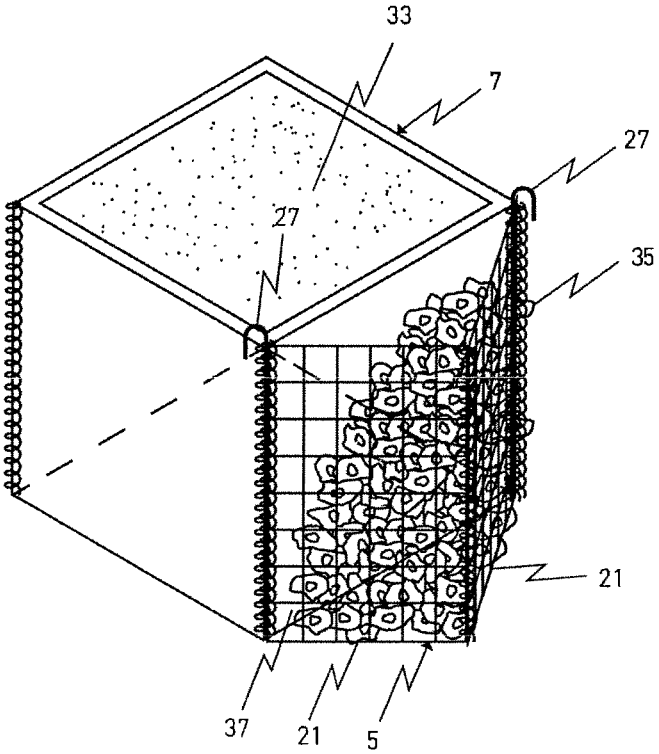
FIG. 6 is a perspective view of the barrier assembly of FIG. 5 in which the triangular compartment is filled with oyster shells.

Referring to FIG. 6, there is depicted the barrier assembly 1 of FIG. 5 in which the geotextile-lined first individual compartment 7 is filled with sand 33. Of course, in other embodiments, the first individual compartment 7 may be filled with vegetation which may grow in an in-land direction. The triangular compartment 5 is filled with oyster shells 35. It can be seen that some oyster shells 35 protrude through the mesh 37 of the panels 21.

Figure 7:
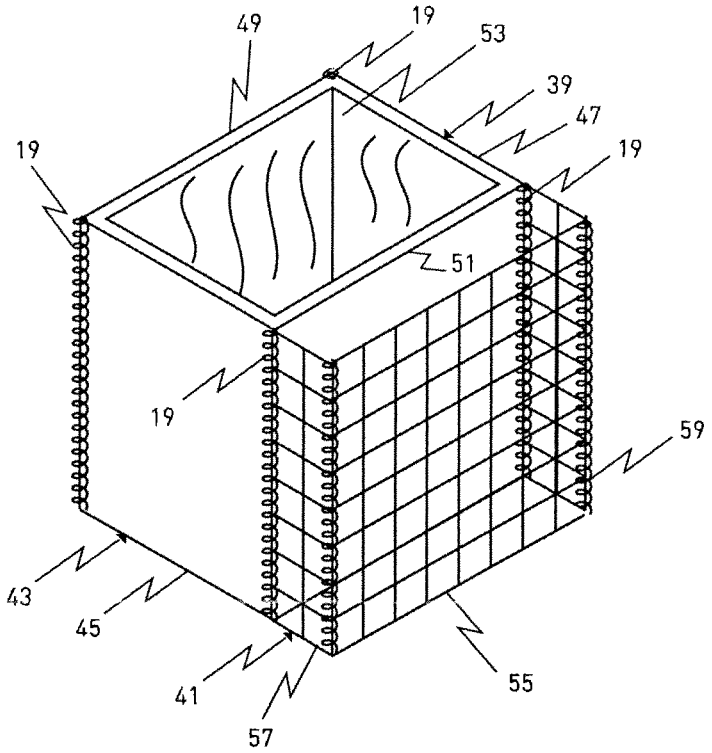
FIG. 7 is a perspective view of a second individual compartment formed according to an embodiment of the present invention.

With reference to FIG. 7, there is illustrated a second individual compartment 39. The second individual compartment 39 has a cuboid shape. The second individual compartment 39 is divided into a smaller chamber 41 and a larger chamber 43. Both compartments 41 and 43 are of equal height. Both compartments 41 and 43 are rectangular prisms the volumes of which amount to the cuboid shape of the second individual compartment 39.

The larger chamber 43 is an open-top rectangular prism formed from five rectangular panels. There are two opposing side walls 49, 51, two partition walls 45, 47 and a base (not shown). These walls 45, 47, 49, 51 are connected at their respective edges by an E. coli 19. The walls are solid, but it will be appreciated that in other embodiments the walls may have a mesh form.

The larger chamber 43 is lined with a geotextile material 53. More particularly, it is the inwardly facing surface of each wall 45, 47, 49, 51 that is lined with the geotextile material 53. The geotextile material 53 acts to hold fill material in place and also provides a filtering mechanism.

The smaller chamber 41 has a width which is a quarter of the width of the larger compartment 43. The smaller chamber 41 is a planar compartment and comprises a planar front panel 55 and two planar side panels 57, 59 which are connected to larger chamber 43 such that the side wall 51 makes up the fourth side of the planar compartment 41. The planar front panel 55 and two planar side panels 57, 59 have a mesh form and define an external surface of the second individual compartment 39. Helical coils 19 connect all panels of the second individual compartment 39.

Figure 8:
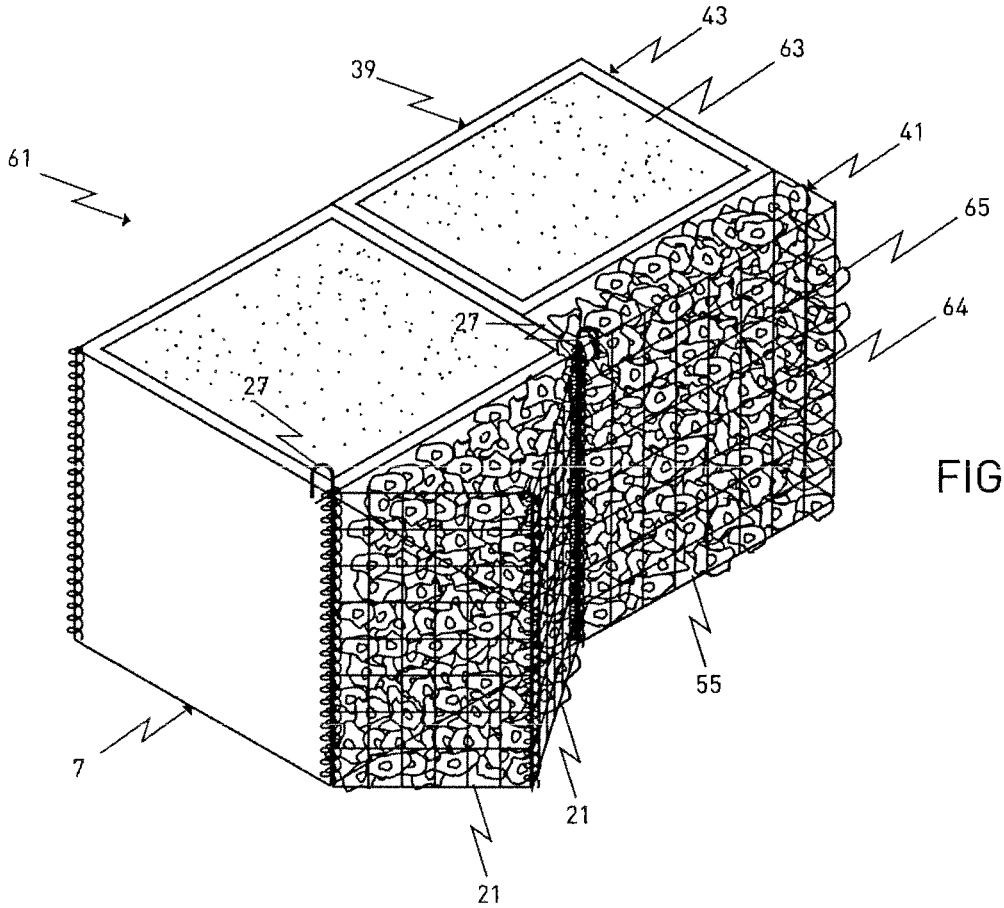
FIG. 8 is a perspective view of a barrier assembly formed from the first individual compartment of FIG. 1 and second individual compartment of FIG. 7.

Referring now to FIG. 8, there is depicted a barrier assembly 61 comprising the first individual compartment 7 of FIG. 6 abutting the second individual compartment 39 of FIG. 7. There is thus depicted a multi-compartmental gabion. Here, the second individual compartment 39 is also shown filled with sand 63 in its larger lined chamber 43, and filled with oyster shells 65 in its smaller chamber 41. It can be seen that some oyster shells 65 protrude through the mesh 64 of the panels 55, 59. The dimensions of the second individual compartment 39 are the same as those of the first individual compartment 7. Angled panels 21 and front planar panel 55 define the external surface of the barrier assembly 61 which encounters the wave energy during use. It may be that the wave energy flows along the surface of the second individual compartment 39 having initially contacted the first individual compartment 7.

During use, the oyster shells 65 attract oysters and other marine life into the surrounding area of the shoreline. Marine life, including oysters, can attach itself to the oyster shells 65 protruding through the open framework of the angled panels 21 and front planar panel 55 whereby to grow outwardly into the sea. This enables the barrier assembly 61 to naturally repair itself without requiring maintenance of the oyster-filled compartment 5 and chamber 41 because the marine life which attaches itself to the barrier assembly 61 essentially becomes part of the barrier assembly 61. Attached marine life can in turn attract further marine life and the cycle may thus continue. This provides a way in which to build or re-establish a self-generating thriving underwater eco-system.

Figure 9:
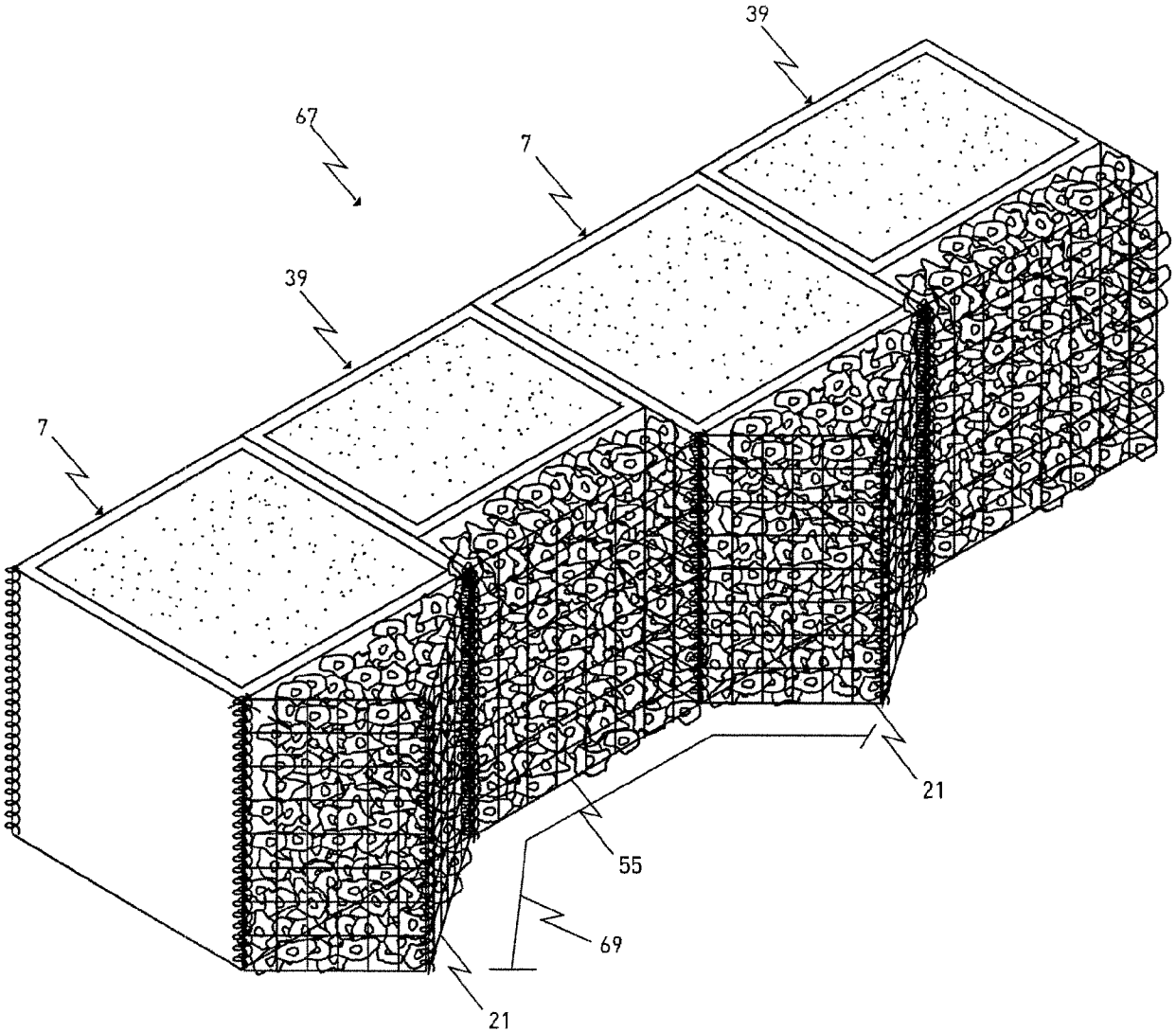
FIG. 9 is a perspective view of a barrier assembly comprising two first individual compartments and two second individual compartments.

With reference to FIG. 9, there is shown a barrier assembly 67 which is similar to that of FIG. 8 except that barrier assembly 67 comprises two first individual compartments 7 and two second individual compartments 39. All compartments 7, 39 are in a linear relationship and alternately positioned. Hence, first individual compartment 7 abuts one side of second individual compartment 39; the other side of second individual compartment 39 abuts one side of another first individual compartment 7; and the other side of that first individual compartment 7 abuts one side of another second individual compartment 39.

Angled panels 21 and front planar panels 55 define the external surface of the barrier assembly 67 which encounters the wave energy during use. A substantially continuous channel (indicated 69) is defined by an angled panel 21 of a first individual compartment 7, a front planar panel 55 of a sandwiched second individual compartment 39, and an angled panel 21 of another second individual compartment 7. The channel 69 is boat-shaped.

The channel 69 may provide a particularly effective way in which to dissipate the wave energy. The wave energy can be concentrated into the channel 69 and dispersed therefrom. The wave energy may be dissipated upwardly or downwardly from the channel 69.

Figure 10:
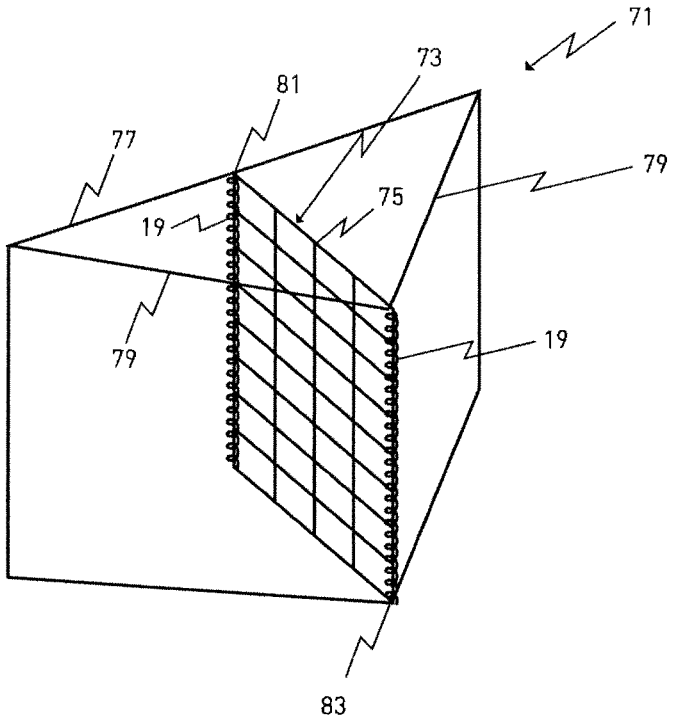
FIG. 10 is a perspective view of a triangular compartment similar to that shown in FIG. 1, but comprising a strengthening member.

FIG. 10 illustrates an alternative embodiment of a protuberant compartment constituted by a triangular compartment 71. In this embodiment, the triangular compartment 71 comprises a strengthening member 73. The strengthening member 73 is in the form of a mesh panel 75.

The triangular compartment 71 comprises a side wall 77 and two angled panels 79. The strengthening member 73 is positioned along the median connecting the interior midpoint 81 of the side wall 77 and the protruding apex 83 of the two angled panels 79. Helical coils 19 effect the connections of the strengthening member 73. It will be appreciated that the strengthening member may be employed in any of the embodiments disclosed herein without undue effort.

Figure 11:
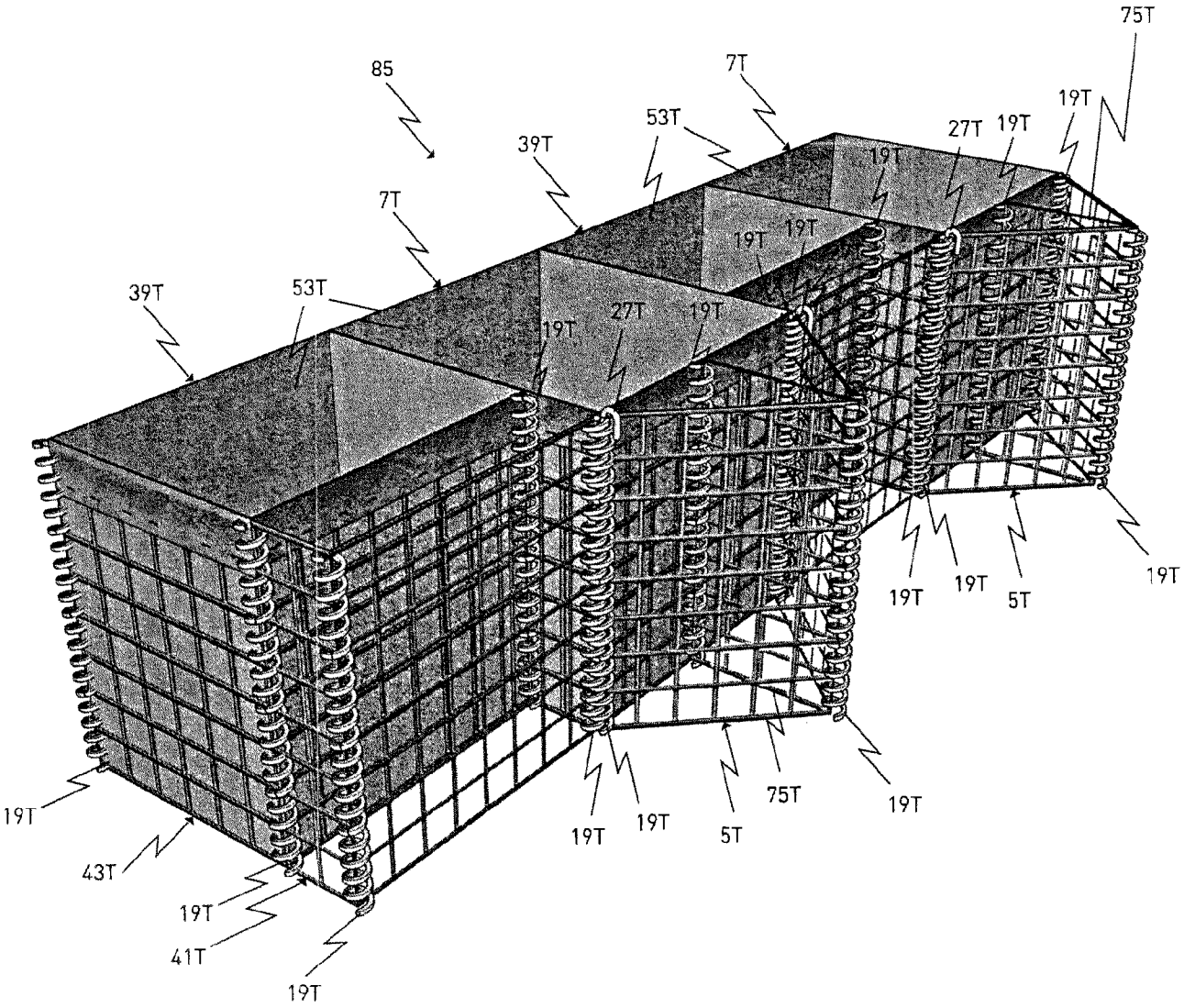
FIG. 11 is a perspective view of a barrier assembly wherein the two first individual compartments and the two second individual compartments are formed from a mesh structure.

With reference to FIG. 11, there is depicted a barrier assembly 85 similar to that shown in FIG. 9, except, in this embodiment, the two first individual compartments 7T and the two second individual compartments 39T are formed from a mesh structure. Second individual compartment 39T is depicted as being divided into two chambers 41T, 43T. A further difference is that barrier assembly 85 comprises two strengthening members 75T within the triangular compartments 5T extending outwardly and away from the first individual compartments 7T. Each triangular compartment 5T connects to its respective individual compartment 39T by way of double helical coils 19T and locking pin 27T in the arrangement as shown in FIG. 3. The barrier assembly 85 is shown with the first and second individual compartments 7T, 39T lined on their inwardly facing surfaces with a geotextile material 53T.

The above description is for the purpose of teaching the person of ordinary skill in the art how to practice the present application, and it is not intended to detail all those obvious modifications and variations of it which will become apparent to the skilled worker upon reading the description. It is intended, however, that all such obvious modifications and variations be included within the scope of the present application, which is defined by the following claims. The claims are intended to cover the components and steps in any sequence which is effective to meet the objectives there intended, unless the context specifically indicates the contrary.

What is claimed is:

1. A barrier assembly for shoreline preservation or restoration, comprising a gabion comprising:

a plurality of partition walls;

opposed side walls connected together at spaced intervals along the gabion's length by the plurality of partition walls, wherein the partition walls are pivotally connected to the side walls, wherein the spaces between neighboring pairs of partition walls defining, together with the side walls, at least one individual compartment of the gabion and wherein the at least one individual compartment of the gabion is bounded by the respective opposed side walls or by opposed side wall sections of the respective opposed side walls; and convergent, at least partly open, framework panels that extend from the at least one individual compartment in directions away from the at least one individual compartment, wherein the convergent, at least partly open, framework panels form a separate protuberant compartment, or part of a separate protuberant compartment, on the gabion, wherein the assembly is collapsible, wherein the at least one individual compartment is at least partly filled with sand, rocks or vegetation, and wherein the protuberant compartment is at least partly filled with oyster shells so as to attract oysters and other marine life to attach to the oyster shells protruding through the open framework of the protuberant compartment, thereby enabling the barrier assembly to naturally repair itself without requiring maintenance of the protuberant compartment or refilling of the protuberant compartment.

2. The barrier assembly of claim 1, wherein the at least one individual compartment has a square-cross section.

3. The barrier assembly of claim 1, wherein the at least one individual compartment is lined with a geotextile material.

4. The barrier assembly of claim 1, wherein at least the protuberant compartment has a mesh form.

5. The barrier assembly of claim 1, wherein the oyster shells are arranged to protrude through the protuberant compartment and/or sit on top of a surface of the protuberant compartment.

6. The barrier assembly of claim 1, wherein the protuberant compartment is detachably attached to the at least one individual compartment.

7. The barrier assembly of claim 1, further comprising a strengthening member for the protuberant compartment.

8. The barrier assembly of claim 7, wherein the strengthening member is in the form of a panel.

9. The barrier assembly of claim 7, wherein the strengthening member is in the form of a mesh panel.

10. The barrier assembly of claim 7, wherein protuberant compartment is a triangular compartment and wherein the strengthening member is positioned along the median of the triangular compartment.

11. The barrier assembly of claim 10, wherein the strengthening member is positioned along the median connecting the midpoint of an interior wall of the triangular compartment and the protruding apex of the triangular compartment.

12. The barrier assembly of claim 1, wherein the protuberant compartment is pivotally connected to the at least one individual compartment.

13. The barrier assembly of claim 1, wherein the protuberant compartment is a triangular compartment.

14. The barrier assembly of claim 13, wherein the triangular compartment comprises two framework panels forming a triangular configuration with the at least one individual compartment.

15. The barrier assembly of claim 14, wherein each edge of the two framework panels is connected to the respective edge of the at least one individual compartment by at least two overlapping helical coils.

16. The barrier assembly of claim 15, wherein the at least two overlapping helical coils are releasably connected by a joining pin intersecting the overlapping region of the coils.

17. The barrier assembly of claim 14, wherein edges of the framework panels which define a protruding apex of the triangular compartment are connected to one another by a single helical coil.

18. The barrier assembly of claim 1, wherein the plurality of partition walls and opposed side walls are not connected to a base.

19. A barrier assembly for shoreline preservation or restoration, comprising a multi-compartmental gabion comprising:

a plurality of partition walls;

opposed side walls connected together at spaced intervals along the gabion's length by the plurality of partition walls, wherein the partition walls are pivotally connected to the side walls, wherein the spaces between neighboring pairs of partition walls defining, together with the side walls, individual compartments of the multi-compartmental gabion, and wherein individual compartments of the multi-compartmental gabion are bounded by opposed side wall sections of the respective opposed side walls; and convergent, at least partly open, framework panels extending from a first individual compartment of the gabion in directions away from the first individual compartment, wherein the convergent, at least partly open, framework panels form a first protuberant compartment, or part of a first protuberant compartment, on the gabion, the gabion further comprising a second individual compartment located next to the first individual compartment, wherein the second individual compartment comprises at least two chambers, wherein the assembly is collapsible, wherein the first protuberant compartment is at least partly filled with oyster shells so as to attract oysters and other marine life to attach to the oyster shells protruding through the open framework of the protuberant compartment, thereby enabling the barrier assembly to naturally repair itself without requiring maintenance of the protuberant compartment or refilling of the protuberant compartment.

20. The barrier assembly of claim 19, further comprising a second protuberant compartment formed on the second individual compartment, wherein the second protuberant compartment is different in size, shape or both from the first protuberant compartment.

21. The barrier assembly of claim 19, wherein the second individual compartment located next to the first individual compartment does not have any protuberant compartment formed thereon.

22. The barrier assembly of claim 19, wherein the chambers of the second individual compartment are unequal in size.

23. The barrier assembly of claim 19, comprising a plurality of protuberant compartments along the length of the gabion, neighboring protuberant compartments being separated from each other by a length of side wall.

24. The barrier assembly of claim 23, wherein the length of side wall is the length of a side wall section.

25. The barrier assembly of claim 24, wherein at least parts of the neighboring protuberant compartments and the length of side wall define a channel.

26. The barrier assembly of claim 19, wherein the multi-compartment gabion comprises an even numbers of compartments.

27. The barrier assembly of claim 19, wherein the first protuberant compartment is a triangular compartment.

28. The barrier assembly of claim 27, wherein the triangular compartment comprises two framework panels forming a triangular configuration with the first individual compartment.

29. The barrier assembly of claim 28, wherein each edge of the two framework panels is connected to the respective edge of the first individual compartment by at least two overlapping helical coils.

30. The barrier assembly of claim 29, wherein the at least two overlapping helical coils are releasably connected by a joining pin intersecting the overlapping region of the coils.

31. The barrier assembly of claim 30, wherein edges of the panels which define a protruding apex of the triangular compartment are connected to one another by a single helical coil.

32. The barrier assembly of claim 27, wherein a protruding apex of the triangular compartment comprises an interior angle which is obtuse.

33. The barrier assembly of claim 27, wherein a protruding apex of the triangular compartment comprises an interior angle which is acute.

34. The barrier assembly of claim 19, wherein the first individual compartment has a square-cross section.

35. The barrier assembly of claim 19, wherein the first individual compartment is lined with a geotextile material.

36. The barrier assembly of claim 19, wherein the first individual compartment is at least partly filled with a fill material.

37. The barrier assembly of claim 19, wherein the first protuberant compartment has a mesh form.

38. The barrier assembly of claim 19, wherein the oyster shells are arranged to protrude through the first protuberant compartment and/or sit on top of a surface of the first protuberant compartment.

39. The barrier assembly of claim 19, further comprising a strengthening member for the first protuberant compartment.

40. The barrier assembly of claim 39, wherein the strengthening member is in the form of a panel.

41. The barrier assembly of claim 40, wherein the strengthening member is in the form of a mesh panel.

42. The barrier assembly of claim 39, wherein the first protuberant compartment is a triangular compartment and the strengthening member is positioned along the median of the triangular compartment.

43. The barrier assembly of claim 42, wherein the strengthening member is positioned along the median connecting the midpoint of an interior wall of the triangular compartment and the protruding apex of the triangular compartment.

44. The barrier assembly of claim 19, wherein the first protuberant compartment is detachably attached to the first individual compartment.

45. The barrier assembly of claim 19, wherein the first protuberant compartment is pivotally connected to the first individual compartment.

46. The barrier assembly of claim 19, wherein the chambers of the second individual compartment together amount to the same dimensions as those of the first individual compartment.

47. The barrier assembly of claim 19, wherein the first individual compartment and the second individual compartment are alternatively positioned when multiple assemblies are placed next to one another.

48. A method of preserving or restoring a shoreline, comprising the steps of: providing a barrier assembly comprising a gabion comprising a plurality of partition walls;

opposed side walls connected together at spaced intervals along the gabion's length by the plurality of partition walls, wherein the partition walls are pivotally connected to the side walls, wherein the spaces between neighboring pairs of partition walls defining, together with the side walls, at least one individual compartment of the gabion and wherein the at least one individual compartment of the gabion is bounded by the respective opposed side walls or by opposed side wall sections of the respective opposed side walls; and convergent, at least partly open, framework panels that extend from the at least one individual compartment in directions away from the at least one individual compartment, wherein the convergent, at least partly open, framework panels form a protuberant compartment, or part of a protuberant compartment, on the gabion;

at least partly filling the at least one individual compartment with a fill material, at least partly filling the protuberant compartment with oyster shells so as to attract oysters and other marine life to attach to the oyster shells protruding through the open framework of the protuberant compartment, thereby enabling the barrier assembly to naturally repair itself without requiring maintenance of the protuberant compartment or refilling of the protuberant compartment; and at least partly lining a shoreline with the barrier assembly.

49. The method of claim 48, wherein the fill material is sand, rocks, vegetation; or combinations thereof.

50. The method of claim 48, further comprising the step of lining the at least one individual compartment with a geotextile material before it receives any fill material.

51. The method of claim 48, further comprising the step of providing at least two individual compartments and positioning them in a linear relationship.

52. A barrier reef comprising the barrier assembly of claim 19.

53. A barrier assembly for shoreline preservation or restoration, comprising a gabion comprising:

a plurality of partition walls;

opposed side walls connected together at spaced intervals along the gabion's length by the plurality of partition walls, wherein the partition walls are connected to the side walls, wherein the spaces between neighboring pairs of partition walls defining, together with the side walls, at least one individual compartment of the gabion and wherein the at least one individual compartment of the gabion is bounded by the respective opposed side walls or by opposed side wall sections of the respective opposed side walls; and convergent, at least partly open, framework panels that extend from the at least one individual compartment in directions away from the at least one individual compartment, wherein the convergent, at least partly open, framework panels form a separate protuberant compartment, or part of a separate protuberant compartment, on the gabion, wherein the protuberant compartment is a triangular compartment detachably attached to the at least one individual compartment, the triangular compartment comprising two framework panels forming a triangular configuration with the first individual compartment, wherein each edge of the two framework panels is connected to the respective edge of the first individual compartment by at least two overlapping helical coils and wherein the at least two overlapping helical coils are releasably connected by a joining pin intersecting the overlapping region of the coils, wherein the protuberant compartment is at least partly filled with oyster shells so as to attract oysters and other marine life to attach to the oyster shells protruding through the open framework of the protuberant compartment, thereby enabling the barrier assembly to naturally repair itself without requiring maintenance of the protuberant compartment or refilling of the protuberant compartment.

* * * * *